United States Patent [19]

Ogren

[11] 4,365,401

[45] Dec. 28, 1982

[54] RIVET REMOVAL AND FASTENING TOOL

[75] Inventor: Robert S. Ogren, Owatonna, Minn.

[73] Assignee: Owatonna Tool Company, Owatonna, Minn.

[21] Appl. No.: 199,197

[22] Filed: Oct. 20, 1980

[51] Int. Cl.[3] ..... B23P 11/00

[52] U.S. Cl. ..... 29/243.53; 59/7; 59/11; 72/453.19

[58] Field of Search ..... 29/243.53, 243.54, 243.55; 72/453.19, 453.15, 453.16, 312, 313; 59/7, 11

[56] References Cited

U.S. PATENT DOCUMENTS

| | | | |
|---|---|---|---|
| 612,507 | 10/1898 | Rothe . | |
| 963,924 | 7/1910 | McSherry . | |
| 1,767,946 | 8/1927 | Scott . | |
| 3,412,597 | 11/1968 | Rains . | |
| 3,747,194 | 7/1973 | Christensen | 29/243.54 |

FOREIGN PATENT DOCUMENTS

| | | | |
|---|---|---|---|
| 420103 | 10/1925 | Fed. Rep. of Germany | 29/243.53 |
| 466932 | 8/1975 | U.S.S.R. | 29/243.53 |

*Primary Examiner*—James L. Jones, Jr.

*Attorney, Agent, or Firm*—Wegner, McCord, Wood & Dalton

[57] ABSTRACT

A hydraulic rivet tool having a pair of opposing supports on a frame one of which holds an anvil and the other supporting a hydraulic cylinder. A hollow sleeve is extensible from the cylinder and carries a guide to clamp the workpiece. Contained within the sleeve for relative movement therewith is a dual purpose piston carrying a rivet engaging member. A spring is interconnected between the sleeve and the piston to restrict their relative motion until the sleeve guide has clamped the workpiece. Hydraulic fluid under pressure delivered to the cylinder first causes the piston and sleeve to extend from the hydraulic cylinder and causes the sleeve to clamp the workpiece. The piston then, overcoming the spring restricting the relative motion between it and the sleeve, continues its movement to perform work on the rivet.

11 Claims, 6 Drawing Figures

RIVET REMOVAL AND FASTENING TOOL

BACKGROUND OF THE INVENTION

1. Field of the Invention

The present invention relates to hydraulically operated rivet tools which clamp a workpiece and thereafter remove a rivet from or fasten a rivet into a workpiece.

2. Description of the Prior Art

Hydraulic rivet tools which sequentially clamp a workpiece and remove or fasten a rivet in the workpiece are well-known to those versed in the art. One type of these tools is provided with a pair of hydraulic cylinders as shown in Scott U.S. Pat. No. 1,767,946. In Scott one hydraulic cylinder, and the contained piston, provides the force necessary to bring the anvil toward and clamp the workpiece to the riveting set or die. The second hydraulic cylinder and contained piston provides the riveting force necessary to peen the rivet. While being adequate to fasten a rivet the use of two cylinders results in tools which require an entire cylinder to be dedicated to the clamping of the workpiece while a separate cylinder provides the riveting force. Furthermore the existence of separate cylinders necessitates complex interconnecting porting for the hydraulic fluid. The use of two hydraulic cylinders and pistons and the attendant porting requirements tended to make these types of machines not only costly but also cumbersome.

A second type of riveting machine provides for the dual use of one hydraulic cylinder as is shown in Rothe Patent 612,507. These tools, as in Rothe, provide for a first piston to extend from the cylinder to clamp the workpiece upon opening a first valve. A second valve is opened causing a second piston to extend from the first to engage the rivet. Once engaged the rivet is peened. This peening of the rivet is completed by the routing of the entire hydraulic fluid, including that used in clamping the workpiece, to the second piston. Even though providing a means to fasten a rivet, tools of this construction are of complex design, do not provide for a simple means whereby the tool can be changed from a rivet peen to a rivet punch, and do not provide for a constant clamping force since the total hydraulic pressure is routed to the rivet engaging piston near the end of its operation. Nor does the second piston contribute in any manner to the clamping of the workpiece. Its single function is to engage and peen the rivet.

SUMMARY OF THE INVENTION

In accordance with the present invention, a hydraulically operated rivet tool is provided which is compact, of simple design and construction, clamps the workpiece with essentially a constant force during engagement with the rivet, and is provided with a means whereby the tool can be easily adapted to either remove or fasten a rivet.

Toward this end the rivet tool of this invention is comprised of a frame having two opposing supports which are capable of spanning the workpiece containing or to contain a rivet. In one support is inserted an anvil which abuts and supports the workpiece. The opposing support has a hydraulic cylinder having its open end directed toward the workpiece. Within the hydraulic cylinder a sleeve is slidably located such that it may extend from the open end of the cylinder, clamp the workpiece to an anvil and position the tool for rivet engagement. Slidably positioned within the sleeve for relative motion therewith is a piston having a rivet engaging member on one end. Interconnected between the sleeve and the piston is a means whereby the relative motion between piston and sleeve is restrained until the sleeve has extended from the cylinder so as to engage the workpiece. Introduction of hydraulic fluid into the hydraulic cylinder will, due to the above construction, cause the piston to have a dual function. First it will act with the end of the sleeve to extend the sleeve from the hydraulic cylinder, in response to fluid pressure, and clamp the workpiece due to the restraint of relative motion between piston and sleeve. This clamping force upon the workpiece is maintained even with deflections in the workpiece. Second, the piston serves to forceably punch or peen the rivet once the sleeve has engaged the workpiece and the means restraining the piston-sleeve relative motion has been overcome. The tool is further provided with a means whereby it can easily be converted from a rivet remover to a rivet fastener and back again by the interchanging of the anvil and the rivet engaging member and their guides.

Accordingly it is an object of this invention to provide a rivet tool which has a simple design and construction. Only one hydraulic cylinder is required and complex porting of the hydraulic fluid is not required.

It is a further object of this invention to provide a tool that is compact and easy to use. The dual use of the piston to aid in the extension of the sleeve to engage and clamp the workpiece for support and alignment and for movement relative to the sleeve to exert force on the rivet results in the efficient use of the hydraulic system. Additionally the clamping force upon the workpiece results in maintaining the alignment of the tool to the rivet thereby simplifying the use of the tool. Furthermore the tool can easily be transformed to either a rivet removing or rivet fastening tool.

Further, objects and advantages of this invention will become apparent from the study of the following portion of the specification, the claims and the attached drawings.

DESCRIPTION

Figure 1:
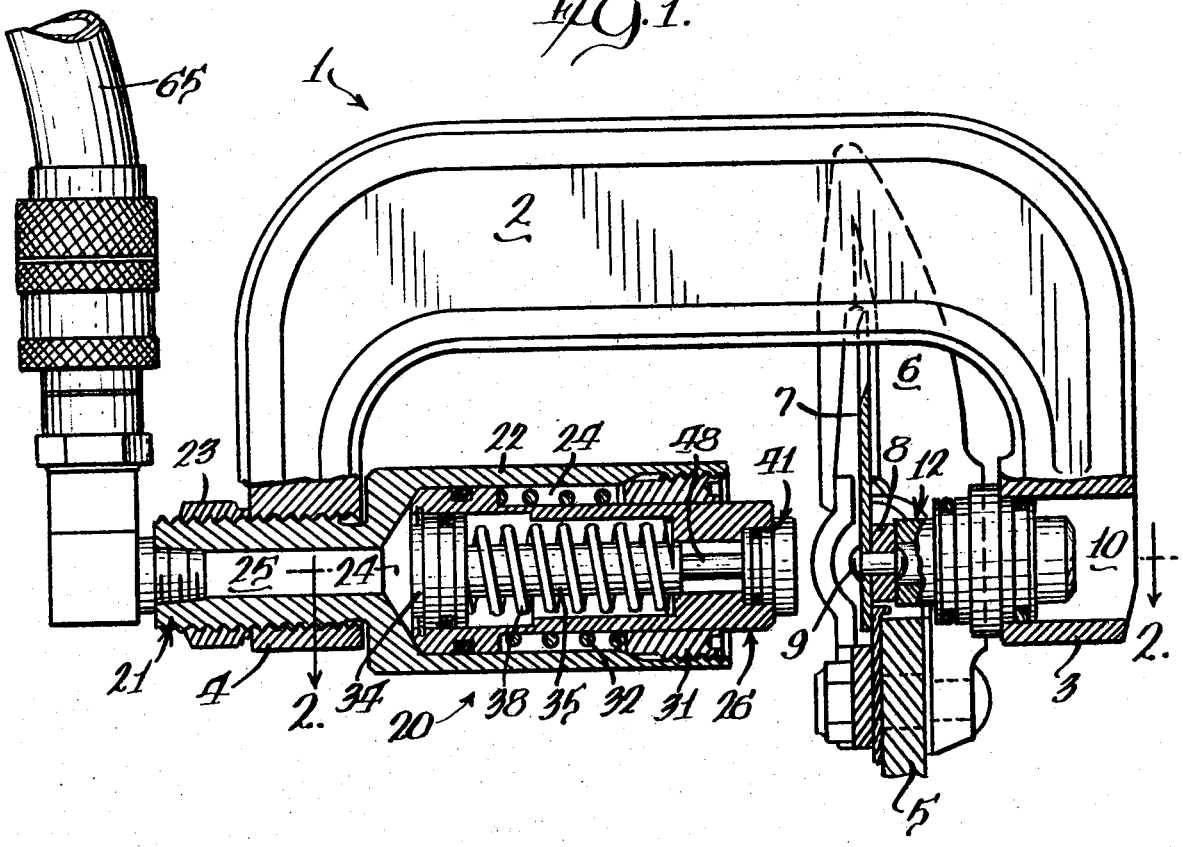
FIG. 1 is a partially cutaway side view of the rivet tool in position to remove a rivet from a sickle.

The rivet tool of this invention is indicated generally at 1 in FIG. 1. This tool 1, as subsequently described, is provided with a piston-cylinder arrangement wherein the piston has a dual function. It will, with the surrounding sleeve, provide not only the impetus to clamp the workpiece and align the tool to the rivet, but will also function to cause a tool to engage and remove or fasten the rivet to a workpiece. To provide a structure within which this piston-cylinder arrangement may operate the tool has a frame 2 which is shown in a C-shaped configuration. It should be noted that the exact frame shape is not critical for the purposes of this invention and that other frames of differing configurations could be used. As part of the frame 2 there are two opposing supports one of which is the anvil support 3 and the other is the hydraulic cylinder support 4, the purposes of which will hereinafter be described.

The frame 2, and attendant anvil support 3 and hydraulic cylinder support 4, are designed so as to span a workpiece depicted generally at 5 in FIG. 1. For purposes of illustration this workpiece 5 is shown as a sickle of the type commonly used as a farm implement for cutting grass and harvesting crops. These sickles typically have a sickle frame 6 surrounding a serrated knife 7. The serrated knife 7 is attached to a mounting strip 8 by a rivet 9. As will be evident from the following description, however, the rivet tool 1 could be applied to any workpiece wherein rivets are used.

Figure 2:
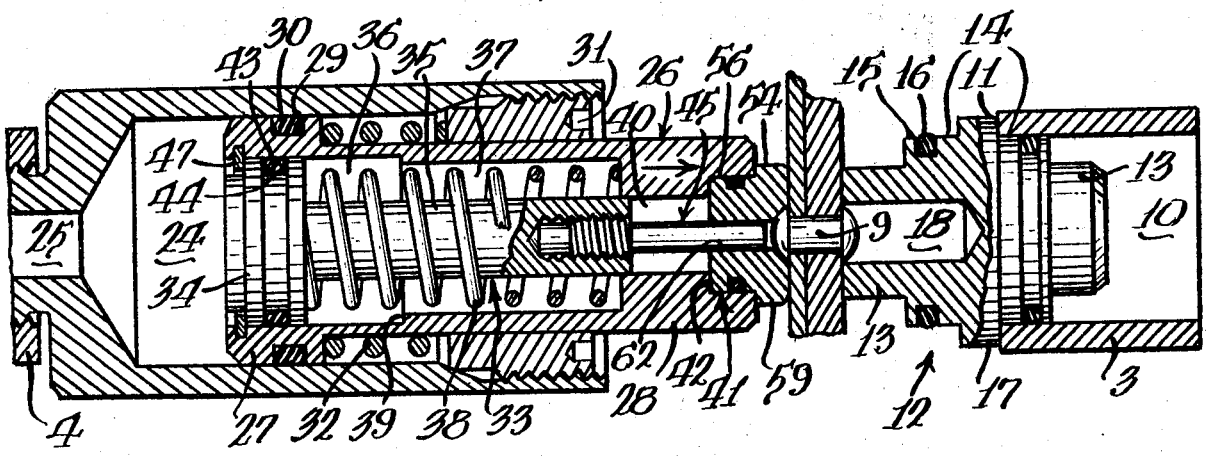
FIG. 2 is a section taken along line 2—2 of FIG. 1 showing the tool clamping the workpiece.
Figure 3:
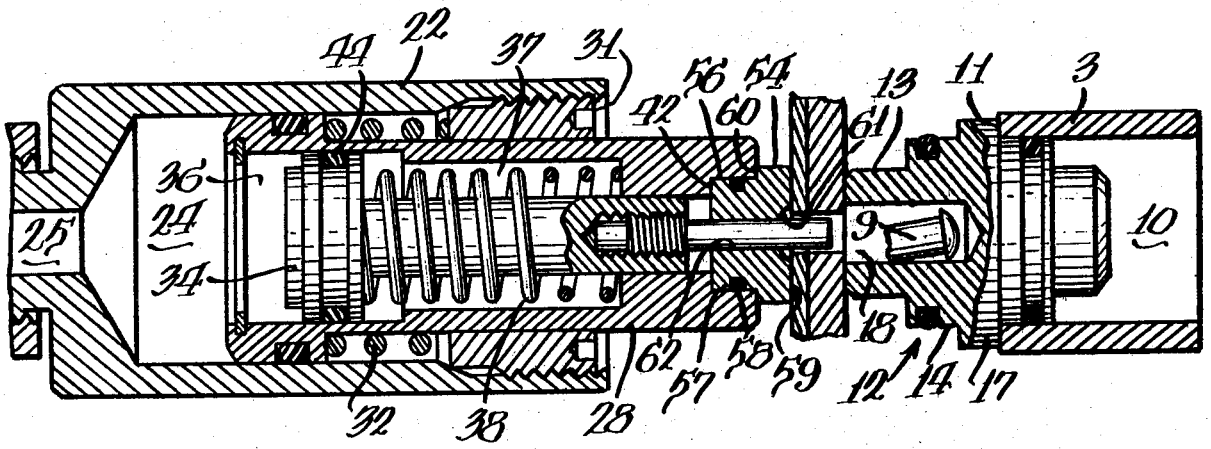
FIG. 3 is a section view of the tool along line 2—2 of FIG. 1 as the tool removes the rivet.
Figure 4:
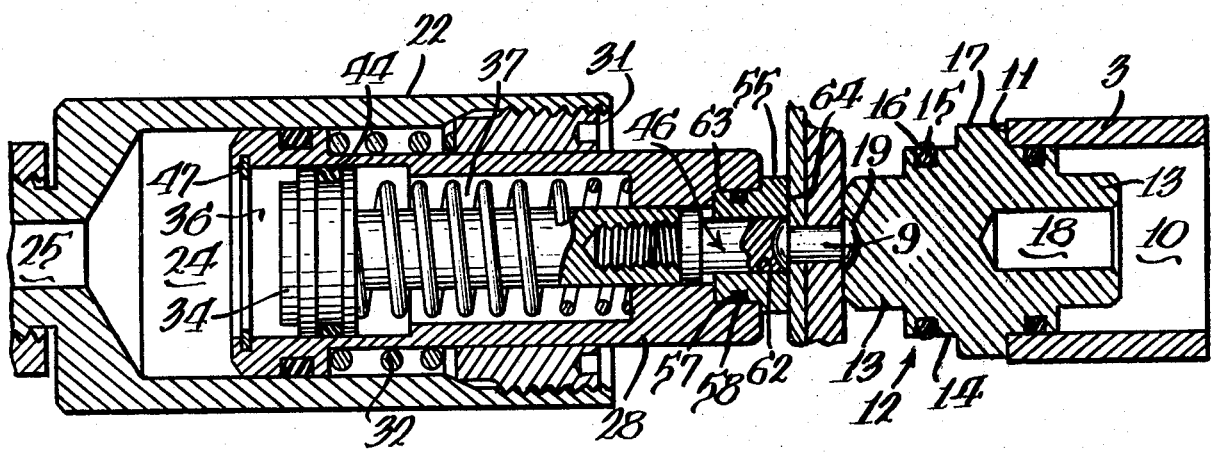
FIG. 4 is a section view of the tool along line 2—2 of FIG. 1 as the tool peens the rivet.

The anvil support 3, as shown in FIGS. 1–4, is of cylindrical shape having its axis so as to be coaxial with the rivet 9 when the tool is to engage the rivet. The anvil support 3 has a face directed toward the opposing hydraulic cylinder support 4 which is flat and perpendicular to the axis of the anvil support 3. Through the face of anvil support 3 and along the axis of anvil support 3 is a bore 10. The bore 10 through the anvil support 3 forms a circumferential lip 11 as shown in FIGS. 2–4. The bore 10 and the attendant circumferential lip 11 form a receptacle in the anvil support 3 to interchangeably receive the anvil 12 as will be hereinafter described.

An anvil 12, formed as a cylindrical plug having three different diameters, is received within the bore 10 of the anvil support 3. The anvil 12 has opposite end portions 13 one of which, depending upon whether the tool is to fasten or remove a rivet, provides support for the workpiece. The end portions 13 have diameters less than that of the bore 10 and have faces thereon which form the ends of the anvil 12. It is these faces which actually abut the workpiece during the employment of the tool. The anvil 12 has a second pair of cylindrical portions 14 inwardly of the end portions 13. These cylindrical portions 14 have diameters equivalent to that of the bore 10 so as to be slidably received into the bore 10 of the anvil support 3. Circumscribed on each of the cylindrical portions 14 are grooves 15 of a size to receive the retaining rings 16. The retaining rings 16 provide a means to frictionally lock the cylindrical portions 14 of the anvil 12 into the bore 10. Intermediate of the ends of anvil 12 is the third cylindrical portion 17 having a diameter larger than the bore 10. The third cylindrical portion 17 abuts circumferential lip 11 when the anvil 12 is fitted into the bore 10 of the anvil support 3 and thereby supports the anvil 12 in the anvil support 3. To provide a means to allow the rivet to pass from the workpiece when the anvil 12 abuts the workpiece a rivet receiving bore 18 of a depth and diameter to receive the rivet when it is freed from the workpiece is made in the face of one end portion 13 and is coaxial to the anvil 12. Likewise, to support the head of rivet 9 and the workpiece while the rivet 9 is being peened, a rivet dolly 19 is formed in the face of the other end portion 13 coaxial to the anvil 12 and is of such a shape as to hold the head of the rivet 9 while it is being peened. In the event that a rivet does not have a head susceptible to being held by the dolly 19, as shown in FIG. 4, the face of the end portion 13 will be formed so as to abut the rivet. An example would be where the head of a rivet is concave whereupon the end portion 13 would be convex to mate with the rivet. The above structure permits the anvil 12 to be affixed to the anvil support 3 while providing a means to interchange which end portion 13 will abut the workpiece. Furthermore, the anvil 12 as described above can support the workpiece and provide either a receptacle for a removed rivet or function as a dolly.

Referring to FIG. 1, the hydraulic cylinder support 4 has an axial threaded bore to threadably receive the hydraulic cylinder assembly 20. The hydraulic cylinder assembly 20 is composed of a threaded section 21 and a hydraulic cylinder 22. The threaded section 21 is threaded and of a diameter to be threadably received into the threaded bore of the hydraulic cylinder support 4 and has a length so as to pass completely through and extend beyond the hydraulic cylinder support 4. To firmly secure the threaded section 21 into the hydraulic cylinder support 4 a locking nut 23 is threadably located on the extending portion of threaded section 21 so as to abut the hydraulic cylinder support 4. The hydraulic cylinder 22 is coaxial to and extends towards the anvil support 3 from the threaded section 21. A chamber 24 is contained coaxially within the hydraulic cylinder 22 and has a closed end, adjacent to the threaded section 21, and an opposing threaded open end. To provide a means to introduce pressurized hydraulic fluid into the chamber 24 a hydraulic conduit 25 extends from the closed end of chamber 24 through and along the axis of the threaded section 21 and exits therefrom.

As shown in FIGS. 2–4, a sleeve 26 is slidably positioned in chamber 24 for movement toward and away from the workpiece. The sleeve 26 is comprised of a sleeve head 27 and a body 28. The sleeve head 26 has a diameter so as to be closely received into chamber 24 and has a circumscribed groove 29 therein. To provide a slidable seal between the sleeve head 27 and the chamber 24 a sleeve head O-ring 30 is located within the groove 29. The sleeve body 28 extends coaxially from the sleeve head 27 toward the anvil support 3 and protrudes from the open end of the chamber 24. A threaded sleeve guide 31 is threadably received into the open end of the chamber 24 and has an axial bore therethrough of a diameter to slidably guide the extension of the sleeve body 28 from the chamber 24 and also provides for support of the coil spring 32. A biasing means, shown as the coil spring 32, is located within the chamber 24 between the sleeve guide 31 and the sleeve head 27 to normally bias the sleeve 26 away from the workpiece. From the above it can be seen that this structure provides a means whereby the sleeve 26 can extend from the chamber 24, against the bias of the coil spring 32 so as to contact the workpiece.

The sleeve 26 has an axial bore of varying diameter which runs the entire length through the sleeve 26. This bore receives the dual service piston 33 which includes piston head 34 and piston stem 35. The head bore 36 of the sleeve 26 has a bore of a diameter to slidably receive the piston head 24 and extends from the left end of the sleeve head 27, as viewed in FIGS. 2–4, to a depth determined by the amount of piston travel desired. Into the head bore 36 is located circumferential groove within which is held the head bore locking ring 47. The head bore locking ring 47 protrudes into the head bore 36 to limit the leftward movement of the piston as viewed in FIGS. 1–4. From the bottom of the head bore 36 the axial bore is reduced to form a biasing receiving chamber 37. The biasing receiving chamber 37 is of a diameter and depth to receive the biasing means for the piston 33 which is shown as a piston spring 38. A piston stem guide 40 bore extends from the bottom of the biasing receiving chamber 37 and has a diameter to slidably guide the movement of piston stem 35 therethrough. The depth of piston stem guide 40 typically approximates the axial length of the rivet 9 so as to guide the piston stem 40 for its entire movement. On the right end of the sleeve body 28, as viewed in the drawings, the axial bore increases to form an end bore 41. The end bore 41 is of a larger diameter than the piston stem guide 40 thereby forming at their interface a circumferential lip 42 the purpose of which will be hereinafter described.

As previously described, the dual service piston 33 is composed of a piston head 34 and a piston stem 35. The piston head 34 is disc shaped having two flat faces and has a diameter to be slidably received into the head bore 36 for relative motion therewith. A groove 43 is circumscribed in the piston head 34 and receives a piston O-ring 44 which serves to provide a slidable seal between the piston head 34 and the head bore 36. The piston stem 35 extends from one of the piston head 34 flat faces toward the workpiece. As depicted in FIGS. 1–4 the piston stem 35 is of a lesser diameter than the piston head 34 and extends from the piston head 35 to the piston stem guide 40 when the piston 33 is retracted. The piston stem 35 has a threaded, axial bore in its end to threadably receive the rivet punch assembly 45 or the rivet peen 46.

Circumferentially located around the piston stem 35 and extending from the bottom of the piston head 34 to the bottom of the biasing receiving chamber 37 is a biasing means shown as a piston spring 38. The piston spring 38, in the preferred embodiment, is a coil spring having a spring modulus significantly greater than that of the sleeve spring 32 and functions to bias the piston 33 away from the workpiece and against the head bore locking ring 47. The head bore locking ring 47, described above, serves to hold the piston 33 within the sleeve 26 against the bias of the piston spring 38. The piston spring 38 provides not only a means to normally bias the piston 33 away from the workpiece, but also restricts the relative motion of the piston 33 to the sleeve 26 until the sleeve 26 has extended to a workpiece clamping position. The interaction of the piston 33, sleeve 26, and the biases against which they operate will be described in detail in subsequent portions of this description.

Figure 5:
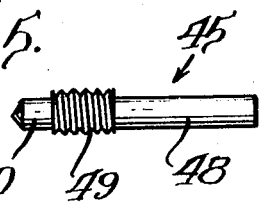
FIG. 5 is a side view of the rivet punch.

To accomplish the rivet removing or rivet fastening a rivet punch assembly 45 or a rivet peen 46 is used. As shown in FIG. 5, the rivet punch assembly 45 is composed of a punch pin 48, and a punch holder 49. The punch pin 48 has a diameter and a length enabling it to engage the rivet 9 and penetrate the workpiece thereby forcing the rivet 9 from the workpiece as shown in FIG. 3. Typically the punch pin 48 has a diameter equal to or slightly less than that of the shaft of the rivet 9 and a length approximately equal to the combined axial lengths of the piston stem guide 40 and the end bore 41. On the end of the punch pin 48, opposite the rivet engaging end, is located the cylindrical pin head 50. The pin head 50 has a diameter greater than that of the pin 48 and is chamfered so as to mate with the bottom of the axial threaded bore in the piston stem 35 when inserted therein.

To hold the pin 48 to the piston stem 35 a punch holder 49 is provided. The punch holder is comprised of a hollow, exteriorly threaded cylinder of a size to be threadably received into the end bore of the piston stem 35. The hollow, or bore, axially through the punch holder 49 is of a size to pass the pin 48 therethrough. The pin head 50 abuts the annular end of the punch holder 49. After receiving the pin 48 the punch holder 49 is threaded into the end bore of the piston stem 35 so as to clamp the pin head 50 between the bottom of the end bore in the piston stem 35 and the punch holder 49. The foregoing connection of the pin 48 and pin head 50 into the end of the piston 35 results not only in a strong punch-piston stem connection but also in a connection which allows for the easy removal of the punch assembly 45 from the tool.

Figure 6:
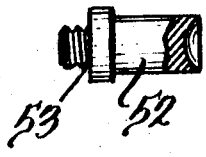
FIG. 6 is a side view of the rivet peen.

The rivet peen 46 is composed of a peen rod 52 and a peen head 53 as depicted in FIG. 6. The peen rod 52 is of a diameter and length to engage the shaft of a rivet to be fastened and peen the rivet thereby affixing it to the workpiece. As shown in FIG. 4 the peen rod 52 has a diameter greater than that of the punch pin 48 and is shown for this embodiment as having a diameter approximately that of the head of rivet 9. The rivet engaging end of peen rod 52 is concave so as to peen rivet 9 into a convex shape assimulating that of a rivet head. The peen rod 52 length is approximately that of the axial length of the end bore 41. Affixed to the end of the peen rod 52 opposing the concave end is the peen head 53. The peen head 53 is comprised of a disc portion and a threaded portion both of which are coaxial to the peen rod 52. The disc portion has a diameter approximately equal to that of the piston stem 35 so as to abut the end of the piston stem 35 and not contact the walls of the piston stem guide 40. On the face of the disc portion opposing the peen rod 52 is a threaded portion of a diameter to be threadably received into the end bore of the piston stem 35. This structure of the peen head 53 provides a means to threadably mount the rivet peen 46 onto the end of the piston stem 35 such that the disc portion of the peen head 53 seats against the end of the piston stem 35 providing a strong peen-piston connection.

To guide the punch assembly 45 and the peen 46 and to provide a surface to clamp the workpiece a guide is used which takes the form of either a punch guide 54 or a peen guide 55. As shown in FIGS. 2 and 3 the punch guide 54 consists of two coaxial discs of differing diameters. The lesser of the two discs forms a sleeve plug 56. The sleeve plug 56 is of a diameter and axial length equal to that of the end bore 41 so that it may be inserted therein and firmly abut against the lip 42. Circumscribed around sleeve plug 56 is a groove 57 for receiving an O-ring 58. The O-ring 58 provides a means whereby the sleeve plug 56 is firmly held in the end bore 41 and against the lip 52. The remaining disc of punch guide 54 forms a sleeve end 59. The sleeve end 59 has a greater diameter than the adjacent sleeve plug 56 and thereby forms a circumferential lip 60 at the point of adjacency. The lip 60 rests upon the end of sleeve 26 when the punch guide 54 is inserted into the end bore 41 to seat the punch not only against the lip 42 but also against the end of sleeve 26. The face of the sleeve end 59 to engage the workpiece and rivet 9 is generally flat having a hemispherical notch 61 at its center. The notch 61 is of a size and shape as to closely fit up to the peened end of rivet 9 as depicted in FIG. 2. The flat face and notch 61 of the sleeve end 59 will, upon operation of the tool, provide a means to not only clamp the workpiece to the anvil 12 but will also serve to align the tool by the coaction of the notch 61, and sleeve end 59, and the peened end of the rivet 9. An axial punch guide bore 62 extends through the punch guide 54 exiting from the notch 61 with a diameter as to closely guide the punch pin 48 to its engagement with the rivet 9.

The peen guide 55 has a construction similar to that of the punch guide 54 thereby providing for interchangeability. It is composed of a sleeve plug 63 coaxial with a sleeve end 64 having the same outer dimensions, lengths, groove and O-ring as the punch guide 54. The sleeve end 64 of the peen guide 55, however, does not have a notch as does the punch guide. Furthermore, due to the larger diameter of the peen rod 52 the axial bore through the peen guide 55 is of a greater diameter to accommodate the peen rod 52. The peen guide 55, like its counterpart the punch guide 54, closely guides the progression of the peen 46 toward the shaft of rivet 9 while clamping the workpiece to the anvil 12.

Motive force for the rivet tool 1 is provided by a pressurized hydraulic fluid supplied by a hose 65. The hose 65, as shown in FIG. 1 is threaded upon its end and is threadably received into the hydraulic conduit 25. Thusly, the fluid has a means whereby it can enter the chamber 24.

With the above defined structure the operation of the tool 1 becomes self-evident. If the rivet 9 is to be removed from the workpiece, the punch assembly 45 is screwed onto the end of the piston stem 35. The punch guide 54 is fitted into the end bore 41 so as to guide the punch 45 and is held in place by the O-ring 58. The anvil 12 is inserted into the anvil support 3 such that the rivet receiving bore 18 will bear upon the head of rivet 9 when the tool is positioned. Next the tool is positioned to engage the rivet 9 by placing the anvil 12 against the workpiece such that the head of rivet 9 extends into the rivet receiving bore 18 and the hydraulic cylinder assembly 20 is directed toward the peened end of the rivet 9 as shown in FIG. 1. Hydraulic fluid under pressure is then caused to flow through the hose 65, the hydraulic conduit 25 and into the chamber 24.

The introduction of the hydraulic fluid into the chamber 24 creates a force against not only the annular end of the sleeve head 27 but also against the piston head 34 to overcome the bias of the sleeve spring 32 and the sleeve 26 slidably extends from the hydraulic cylinder 22 towards engagement with the workpiece. The piston 33 during the extension of the sleeve 26 is stationary within the sleeve 26 due to the bias of the piston spring 38 which holds the piston 33 firmly against the head bore locking ring 47. As the sleeve 26 extends further from the hydraulic cylinder 22 the punch guide 54 and more particularly the sleeve end 59 contacts the workpiece whereupon the clamping of the workpiece to the anvil 12 and the alignment of the tool begin. The engagement of the workpiece and the rivet 9, due to the original positioning of the anvil 12 upon the workpiece such that the head of rivet 9 extends into the rivet receiving bore 18, occasions the reception of the peened end of the rivet 9 into the notch 61 of the sleeve end 59 as shown in FIG. 2. The above described contact of the sleeve end 59 with the workpiece necessarily halts the extension of the sleeve 26 from the hydraulic cylinder 22. Continued pressure is translated to a clamping force upon the workpiece and the forceable alignment of the notch 61 upon the peened end of the rivet 9. Continued pressure also overcomes the bias on the piston 33 by the piston spring 38, and the piston 33 moves relative to the sleeve 26. Compression of the piston spring 38 during the relative movement of the piston 33 results in an additional clamping and aligning force to the already present force created by the hydraulic pressure against the annulus of the sleeve head 27. From the foregoing the first purpose of the dual purpose piston 33 is shown. The piston 33 adds to the sleeve the area upon which the hydraulic pressure creates the force necessary to extend the sleeve toward engagement of the workpiece.

When the piston 33 has traveled a sufficient distance against its bias the rivet punch assembly 45 and more particularly the punch pin 48 engages the rivet and thereafter the punch pin 48 forceably punches the rivet from the workpiece and into the rivet receiving bore 18 as depicted in FIG. 3. During the punching of the rivet 9 the clamping force is propositional to the force applied to the rivet because of the movement of the piston 33 and the compression of the piston spring 38. To complete the operation of the tool 1, upon the removal of the rivet 9 from the workpiece the hydraulic fluid in the chamber 24 is vented back through the hydraulic conduit 25 which in turn decreases the pressure in the chamber 24 and its resultant forces. The reduction of the resultant force causes the retraction of the piston 33 and the sleeve 26 due to the bias of the springs.

Conversion of the tool 1 from the punch tool described above into a tool to peen a rivet a simple interchange of parts is all that is required. The anvil 12 is removed from the anvil support 3 and reinserted such that the end portion 13 containing the rivet dolly 19 will bear upon the workpiece on the rivet 9. The punch guide 54 is pulled from the end bore 41 of the sleeve 26 and the punch assembly 45 is threadably removed from the end of the piston stem 35. Into the piston stem 35 the rivet peen 46 is threadably inserted into position. Finally the peen guide 55 is inserted and locked by the O-ring 58 into the sleeve end bore 41. From the above the tool 1 is ready to engage and peen a rivet 9 into the workpiece. Operation of the tool 1 during its peening operation is sequentially and functionally the same as the use of the tool to remove a rivet 9 from the workpiece as was previously discussed.

While I have shown and described certain embodiments of this invention, it is to be understood that it is capable of many modifications. Changes, therefore, in the construction and arrangement may be made without departing from the spirit and scope of the invention as disclosed in the appended claims.

I claim:

1. A rivet tool comprising:

a frame having a first support opposed by a second support;

an anvil mounted in said first support for supporting the workpiece;

a hydraulic cylinder mounted in said second support and having a closed end and an open end directed toward the workpiece;

a sleeve having a head end sealingly and slidably located within said cylinder with another end for clamping said workpiece extensible beyond said open end of said cylinder;

a piston located within said sleeve for relative movement therewith and having a rivet engaging member thereon;

means for preventing the movement of said piston relative to said sleeve until said sleeve has clamped the workpiece; and a hydraulic conduit connected to the closed end of said cylinder whereby fluid under pressure enters the closed end of said cylinder through said conduit to cause the sleeve and piston to move as a unit due to said preventing means until said sleeve clamps the workpiece whereupon the piston moves relative to the sleeve to cause the rivet engaging member to engage the rivet.

2. A rivet tool as described in claim 1 wherein the rivet engaging member is a rivet peen.

3. A rivet tool as described in claim 1 wherein the rivet engaging member is a rivet removing punch.

4. A rivet tool as described in claim 1 wherein the rivet engaging member is interchangeably a rivet peen or a rivet removing punch.

5. A rivet tool for use with a rivet in a workpiece, said tool comprising:

a frame having a first support opposed by a second support;

an anvil mounted in said first support for supporting the workpiece and having a rivet head mating aperture therein;

a hydraulic cylinder mounted in said second support and having a closed end and an open end directed toward the workpiece;

a sleeve slidably located within said cylinder with one end thereon for clamping the workpiece said one end being extensible from said cylinder open end and retractable from the workpiece;

first biasing means between said sleeve and said cylinder to normally bias said sleeve one end away from the workpiece;

a piston movably mounted within said sleeve for relative movement therewith toward the rivet and having a rivet engaging member thereon, said piston together with an end of the sleeve forming an area responsive to fluid pressure within the closed end of the cylinder;

second biasing means between said sleeve and said piston for preventing the movement of said piston relative to the sleeve until said one end of the sleeve clamps the workpiece; and a hydraulic conduit connected to the closed end of said cylinder for directing pressurized fluid therein to cause the sleeve and piston to move together against said first biasing means toward the workpiece as a unit due to said second biasing means until the sleeve one end clamps the workpiece whereupon the piston moves relative to the sleeve to cause the rivet engaging member to engage the rivet and subsequent relief of said pressurized fluid from said cylinder causes said sleeve one end to retract from said workpiece due to said first biasing means.

6. A rivet tool as described in claim 5 wherein rivet head mating aperture in the anvil is a dolly and the rivet engaging member is a peen.

7. A rivet tool as described in claim 5 wherein the rivet head mating aperture in the anvil is a bore to freely pass the removed rivet and the rivet engaging member is a rivet removing punch.

8. A rivet tool as described in claim 5 wherein said first and second biasing means are springs.

9. A rivet tool for use with a rivet in a workpiece such as a knife section of a sickle and its mounting strip, said tool comprising:

a C-shaped form having a first support and an opposing second support;

an anvil having a plurality of work supporting faces thereon for supporting the workpiece and each face having at least one rivet head mating aperture therein;

means for changing which of said faces and which of said apertures is to bear upon the workpiece and the rivet head;

a hydraulic cylinder mounted in said second support and having a closed end and an open end directed toward the workpiece;

a sleeve slidably mounted within said cylinder for telescopic movement therewith and having one end for clamping the workpiece;

a piston slidably mounted within said sleeve for relative axial movement therewith and having one end for receiving a rivet engaging member, said piston and sleeve being movable together in response to fluid pressure within the closed end of the cylinder;

a rivet engaging member affixed to said one end of said piston; and a biasing means interconnected between said sleeve and said piston to cause movement of the piston with the sleeve until said sleeve one end contacts the workpiece.

10. A rivet tool as described in claim 9 wherein the biasing means is a coil spring.

11. A rivet tool for use in a workpiece such as a knife section of a sickle and its mounting strip, said tool comprising:

a C-shaped frame of a size to span the workpiece and having a first support and an opposing second support;

a cylindrical anvil having opposed flat ends to bear against said workpiece, one of said ends containing a dolly and the other end having a rivet receiving bore therein, said anvil being reversibly supported by said first support;

a hydraulic cylinder mounted in said second support having a closed end opposed by an open end which is directed toward the said first support;

a sleeve slidably located within said hydraulic cylinder so as to be extensible from the said open end and having one end to clamp the workpiece to said anvil;

a piston slidably positioned within said sleeve for relative movement therewith and having one end for interchangably receiving a rivet punch or a rivet peen;

a rivet punch guide to slidably guide said punch;

a rivet peen guide to slidably guide said peen;

means to interchangeably insert the said punch guide or the peen guide into the said sleeve one end for clamping the workpiece;

a coil spring interconnected between the hydraulic cylinder and said sleeve to normally bias the sleeve away from the workpiece;

a second coil spring interconnected between said sleeve and said piston to bias the piston away from the workpiece and restrain the relative movement between said piston and said sleeve until said sleeve clamps the workpiece; and a hydraulic conduit connected to the closed end of said hydraulic cylinder whereby fluid under pressure enters the closed end of said hydraulic cylinder through said conduit to cause unitary extension of the sleeve and piston to contact the workpiece and thereafter upon relief of said fluid from said cylinder to cause said piston to move relative to said sleeve against said second coil spring to cause said punch or peen to engage the rivet.

* * * * *